US010351278B2

(12) United States Patent
Chierchia et al.

(10) Patent No.: US 10,351,278 B2
(45) Date of Patent: Jul. 16, 2019

(54) VACUUM PACKAGING ARRANGEMENT, KITCHEN CABINET AND KITCHEN FURNITURE

(71) Applicant: Electrolux Appliances Aktiebolag, Stockholm (SE)

(72) Inventors: Lucia Chierchia, Forli (IT); Piero Turchetti, Forli (IT); Christoph Walther, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 443 days.

(21) Appl. No.: 15/035,668

(22) PCT Filed: Oct. 21, 2014

(86) PCT No.: PCT/EP2014/072477
§ 371 (c)(1),
(2) Date: May 10, 2016

(87) PCT Pub. No.: WO2015/106846
PCT Pub. Date: Jul. 23, 2015

(65) Prior Publication Data

US 2016/0280406 A1 Sep. 29, 2016

(30) Foreign Application Priority Data

Jan. 17, 2014 (EP) ..... 14151514

(51) Int. Cl.
*B65B 31/00* (2006.01)
*B65B 31/04* (2006.01)
(Continued)

(52) U.S. Cl.
CPC ..... *B65B 31/00* (2013.01); *A47B 77/08* (2013.01); *B65B 31/048* (2013.01); *B65B 51/22* (2013.01);
(Continued)

(58) Field of Classification Search
CPC ..... B65B 31/00; B65B 31/048; B65B 57/16; B65B 51/22; B65B 57/18; A47B 77/08;
(Continued)

(56) References Cited

U.S. PATENT DOCUMENTS 5,156,190 A * 10/1992 Staley, Jr. ..... F16L 9/18 137/312
7,044,154 B2 * 5/2006 Henderson ..... E03B 7/071 137/312
(Continued)

FOREIGN PATENT DOCUMENTS

EP 2062823 A1 5/2009
EP 2168876 A2 3/2010
WO 2012174339 A2 12/2012

OTHER PUBLICATIONS

International Search Report issued in PCT/EP2014/072477 dated Jan. 22, 2015, 3 pages.
(Continued)

*Primary Examiner* — David J Walczak
(74) *Attorney, Agent, or Firm* — Pearne & Gordon LLP

(57) ABSTRACT

A vacuum packaging arrangement comprises a drawer configured to cooperate with a kitchen cabinet, and a vacuum packaging device. The vacuum packaging device is functionally integrated in a ready-to-operate configuration within the drawer and provides, within the drawer, an operational interface to receive a minor first section of a vacuum bag, and to vacuum the vacuum bag upon activation of the vacuum packaging device. The vacuum packaging device is
(Continued)

implemented such that a major second section of the vacuum bag comprising a closed end of the vacuum bag is arranged outside of the vacuum packaging device.

21 Claims, 4 Drawing Sheets

(51) Int. Cl.

| | |
|---|---|
| ***B65B 57/16*** | (2006.01) |
| ***B65B 57/18*** | (2006.01) |
| ***B65B 51/22*** | (2006.01) |
| ***A47B 77/08*** | (2006.01) |
| ***A47B 77/12*** | (2006.01) |

(52) U.S. Cl.
CPC ..... *B65B 57/16* (2013.01); *B65B 57/18* (2013.01); *A47B 77/12* (2013.01)

(58) Field of Classification Search
CPC ..... A47B 77/12; A47B 77/04; A47B 77/10; A47B 77/16; A47B 77/18
See application file for complete search history.

(56) References Cited

U.S. PATENT DOCUMENTS

| | | | | |
|---|---|---|---|---|
| 8,915,093 | B2 * | 12/2014 | Espinosa | A47F 3/001 62/100 |
| 9,296,542 | B2 * | 3/2016 | Ho | B65D 81/2038 |
| 2003/0140603 | A1 | 7/2003 | Krasenics, Jr. et al. | |
| 2005/0039420 | A1 | 2/2005 | Albritton et al. | |
| 2007/0155607 | A1 | 7/2007 | Bassett et al. | |
| 2009/0255221 | A1 | 10/2009 | Lyman, Jr. | |

OTHER PUBLICATIONS

Extended European Search Report issued in corresponding European Patent Application No. 16184156.4 dated Dec. 21, 2016, 9 pages.
European Search Report issued in corresponding European Patent Application No. 16184156.4 dated Feb. 9, 2018, 5 pages.

* cited by examiner

VACUUM PACKAGING ARRANGEMENT, KITCHEN CABINET AND KITCHEN FURNITURE

The present application in particular is directed to a vacuum packaging arrangement, in particular configured to be implemented with a kitchen cabinet.

Methods for preparing food in sous vide cooking technique become increasingly popular, as food in this way can be gently prepared, and it is possible to provide vacuum-packaged food requiring only short preparation times. The key part of the sous vide technique is the sealing of the raw food along with all recipe ingredients into a bag that is vacuumed and sealed.

With regard to integrated vacuum sealing devices, it is known for example from US 2008/0302253 A1 to provide in kitchen cabinets at least one separate lid vacuum machine with a vacuum packaging apparatus. However, the lid vacuum sealing devices show a comparatively complex design requiring comparatively complex construction, leading to comparatively high product prices or cost of the product.

Therefore, a vacuum packaging arrangement shall be provided which is adapted to remove the problems observed with the state of the art devices. In particular a vacuum packaging arrangement shall be provided which may be implemented in a comparatively easy, cheap and space saving design in a kitchen cabinet or kitchen furniture, and, inter alia, which allows a comparatively cost-efficient way of vacuuming food products.

This object is solved by claims 1, 16 and 17, preferred embodiments in particular result from the dependent claims and the following description.

The inventors realized, that the so-called clamp and weld machine represents an alternative to lid type machines, which allows food to be vacuum packaged in a comparatively cost efficient, yet high quality manner. In clamp and weld machines, vacuum is created in a relatively small volume in which only a minor section of a plastic bag accommodating the food to be vacuumed is kept, namely the open side of the bag itself, and welding happens on the line where the minor section is held or pressed together by a clamp-like action apart or clamp-like actuator from the rest of the bag, where food is actually stored or accommodated. This clamp and weld technology is able to provide vacuumed products much cheaper and convenient than lid type machines as mentioned above. So far, no application is known or has been suggested, in which a clamp and weld type vacuum appliance is built-in and functionally integrated in an enclosure of a kitchen or similar.

According to claim 1, a vacuum packaging arrangement comprising a drawer which is adapted and configured to cooperate with a kitchen cabinet, and a vacuum packaging device adapted and configured for vacuum packaging items in vacuum bags is provided.

The vacuum packaging device in particular shall be understood to be a device for vacuum packaging items, in particular food items. The vacuum packaging device in particular shall be understood as a vacuum-chamber free device, i.e. a device where vacuum packaging is obtained without placing the object to be vacuumed into a vacuum chamber.

The term drawer in particular shall be understood to define a box-type lidless storage compartment, in particular of a kitchen cabinet, configured to be moved slidably and/or swivellably in and out of a piece of a desk, chest or piece of furniture, in particular a kitchen furniture or kitchen cabinet.

According to the invention, the vacuum packaging device in particular is functionally integrated in a ready-to-operate configuration within the drawer. This shall mean that the drawer may provide a connector interface adapted to at least electrically connect the vacuum packaging device within the drawer irrespective of the drawer position. In particular, opening the drawer, i.e. pulling out the vacuum packaging device together with the drawer may bring the vacuum packaging device in a configuration which allows the vacuum packaging device to be operated according to its ordinary use.

As proposed by the invention, the drawer, in particular the inner configuration thereof, provides an operational interface, which may be configured to receive an open end, i.e. an open ended section, of a vacuum bag. The vacuum bag for example may contain food items and the like. The vacuum packaging device is further adapted to vacuum the vacuum bag section, i.e. open end section of the vacuum bag, arranged external to the vacuum packaging device upon activation of the vacuum packaging device.

With the invention, the operational interface may be configured to receive a minor first section, in particular an open-end section, of a vacuum bag that comprises an open end of a vacuum bag and to vacuum the vacuum bag upon activation of the vacuum packaging device, at the open end section of the vacuum bag.

With the invention, the vacuum packaging device is implemented such that a major second section of the vacuum bag that comprises a closed end of the vacuum bag is arranged outside of the vacuum packaging device.

In embodiments, the vacuum packaging device may be adapted such that an outer surface of at least the major second section is exposed to atmospheric pressure during vacuumizing.

The drawer may in particular comprise a power supply interface and/or connector, in particular an electrical interface, preferably a plug connector interface, configured such that a power supply to the vacuum packaging device can be implemented as a fixed, in configurations detachable, connection between the drawer structure and device. The vacuum device may be fixedly installed within the drawer, but it shall in variants also be possible, that the vacuum packaging device be installed removably within the drawer such that it can be placed in and be removed from the drawer according to user's needs.

The drawer and/or vacuum device may comprise fixtures adapted and configured to ensure stability or stable attachment during sliding movement of the drawer. Respective fixtures also may be adapted to reduce transmission of vibrations to and from the drawer, in particular the furniture, during vacuuming operations and/or opening and closing operations of the drawer.

The drawer in particular may be a push loading drawer. The drawer for example may be supported by a main frame of a kitchen furniture, in particular such that it can cooperate with a kitchen cabinet while being mounted slideably in horizontal direction. The push loading drawer may have dimensions in height, width and depth of about 140 mm, 600 mm and 540 mm.

The vacuum packaging device configured and adapted for vacuum packaging items, in particular food items, may be adapted to package food such as meat and the like. The vacuum packaging device may be implemented in dimensions like 100 mm in height, 450 mm in width and 250 mm in depth, in particular with respect to a front face of the drawer.

The proposed vacuum packaging device may be accommodated or mounted in a ready-to-use operational state within the drawer, i.e. in the interior, in particular in the interior volume, of the drawer. This in particular shall mean that the vacuum packaging device may be readily operated upon opening the drawer.

In particular, the vacuum packaging device may be accommodated in a drawer subsection of the interior of inner volume of the push loading drawer. The drawer subsection may be any segment of the inner volume of the push loading drawer suitable for accommodating therein the vacuum packaging device. Preferably the drawer dimension and/or dimension of the vacuum packaging device and/or the dimension of the drawer subsection are adapted, in particular matched, to leave enough operational space for vacuuming items, such as food items and the like. The operational space available for vacuuming operations preferably is implemented at a front section of the drawer.

A vacuum packaging device shall be understood to implement a complete or self-contained unit, in general operable independently from the drawer status, in particular operable as a whole within the inner volume of the drawer.

The vacuum packaging device in particular may be a clamp and weld type vacuum machine. In particular it shall be possible that it can be removed from and/or fixedly installed within the drawer. One of the key differences between clamp and weld and lid type machines as mentioned further above is the area of action of vacuum. In lid type machines, the whole process chamber where bag is located is vacuumed, while, in clamp and weld machines, only a minor section of the plastic bag is kept, namely the open side of the bag itself, and welding happens on the line where the minor section is held or pressed together by a clamp-like action apart or actuator from the rest of the bag, where food is actually stored. The evacuation of air from the bag happens due to the atmospheric pressure acting on its surfaces.

Clamp and weld vacuum machines are in particular suitable for supporting sous-vide technique, as described further above.

In preferable variants, the drawer may comprise some residual surfaces or spaces available as a type worktop area to perform bag vacuuming operations.

In particular, there may be a distance between a surface on which the vacuum bag rests or is positioned during vacuuming and the clamp line where the vacuum bag is sealed. The distance is favourably implemented in such a way to overcome or at least reduce the probability of liquid penetrating the vacuum area. Preferably, the resting surface is implemented at a lower level as the sealing line, such that gravity will work against undesired liquid flow into the vacuum area.

In embodiments and variants, an automatic liquid detection system may be provided which is adapted to stop a vacuuming operation upon detection of liquid entering, penetrating or being present in the vacuum area. These measures in particular are able to prevent damages to the vacuum pump.

It shall be mentioned that the inventive concept does not require identification between the drawer and the vacuum machine, but instead proposes an integration of the two parts, i.e. device and drawer, which keeps at some extent the functionalities of both, e.g. the possibility to store consumables in the available space and the possibility of vacuuming.

The drawer, in particular push loading drawer, in particular is configured to be integrated or to cooperate with a kitchen cabinet. The push loading drawer in particular may be implemented to be moveable in a horizontal direction with respect and within the kitchen cabinet. Slide fittings in particular may be provided in order to slidably connect the push loading drawer to the kitchen cabinet.

The drawer may comprise a horizontal bottom panel and four vertical walls running along the edges of the bottom panel. This in particular means that the drawer defines an inner volume configured to accommodate therein items, in particular the vacuum packaging device, and during operation at least in part vacuum bags and/or food items.

The proposed vacuum packaging arrangement has the advantage that it can be implemented in kitchen cabinets, in particular domestic kitchen cabinets, in particular in a space saving manner and at comparatively low costs as compared to known solutions of integrated vacuum cooking or packaging apparatuses. Further, the functionality of the kitchen cabinet may be greatly enhanced, as it is possible to obtain a multi-functional cabinet drawer providing vacuuming options and, at least to a certain extent, stowage options at the same time. In addition, a fully functioning and ready-to-use vacuuming option can be implemented without requiring major adaptations to the design and construction of the cabinet and/or drawer. A further advantage is, that the implementation of the vacuum packaging device in connection with a drawer of a kitchen cabinet may result in additional workspace during operation of the vacuum packaging device, as it can be used in full functionality within the drawer, and the opened or pulled out the drawer may provide additional workspace.

In embodiments, it may be provided that the interface comprises a welding unit configured for vacuum-tightly sealing vacuum bags by generating a vacuum bag welded seam. The interface preferably may further comprise a clamping unit configured for clamping the vacuum bag open end section at least during generating the welded seam. In variants, the interface may be configured and designed such that the vacuum bag open end section is positioned and held in an upward orientation, in particular relative to the rest of the vacuum bag or at least relative to sections thereof filled with food.

In embodiments it may be provided that the vacuum packaging device is accommodated in a first section of the inner of the drawer, and that a second section of the drawer, different from the first section and located external to the vacuum packaging device, is configured to accommodate and support the vacuum bag while being vacuum packaged, i.e. processed. In particular, the second section can be regarded as an extension or enlargement of the work space or work surface commonly provided by kitchen cabinets.

In embodiments, the second section, accommodating the major part of the vacuum bag, is at a lower level relative to or as compared to the first section.

The difference in the height level in particular may be such that a height difference between the first section and the second section is such that at least the major section of the vacuum bag can or is able to rest substantially upright, or standing up, during vacuuming.

The height difference between the first and second section in particular has the advantage that due to the action of gravity penetration of liquids into the vacuum pump may be greatly prevented or the entrance of liquids may at least be greatly limited.

In embodiments, the vacuum packaging arrangement may comprise a sensor arrangement, in particular comprising at least one sensor, wherein the sensor arrangement, and in particular the sensor, is adapted and configured to detect liquid flowing out of the major section of the vacuum bag during vacuuming, in a direction towards a vacuum pump of the vacuum packaging device. The sensor arrangement and sensor in particular may be adapted and connected to a control unit adapted and configured to stop, or at least issue a warning, in case that a liquid flow or escape from the major section towards the vacuum pump is detected.

In embodiments it may be provided, that the first section and the second section correspond to a first and second partial volume of the interior of the drawer, and that a bottom section of the drawer in the second partial volume is configured as a support surface for supporting vacuum bags and its contents while being vacuum packaged.

In embodiments and variants it may be provided that the drawer comprises at least one third partial volume, distinct from the first and second section, and configured for accommodating therein vacuum packaging machine related consumables or other items. In particular, the third partial volume may be used as a stowage section. Such stowage sections in particular contribute to the multi-functionality of the proposed vacuum packaging arrangement.

In embodiments, the drawer may comprise a back wall and a front wall on opposite side, wherein the first partial volume may be located in a rear drawer subsection adjacent, in particular immediately adjacent, to the back wall, and the second partial volume may be located in a front drawer subsection adjacent, in particular immediately adjacent, to the front wall. Preferably, the first and second partial volume are immediately adjacent to each other, and in combination preferentially extend over the whole depth of the drawer, i.e. over the length between the back wall and front wall.

In embodiments, the drawer may comprise two lateral side walls, wherein the first partial volume is located adjacent, in particular immediately adjacent, to one of the lateral side walls. The second partial volume may be located adjacent, in particular immediately adjacent to the other side wall. In variants, the first and second partial volumes may be arranged adjacent, in particular immediately adjacent to one another. Here, the first and second partial volumes may spread over the whole width of the drawer. However, it is also possible that at least one of the side walls is an inner lateral wall running from front to back of the drawer, and separating the first and/or second partial volume in lateral direction from an outer side wall of the drawer. In particular in these cases, a space between the inner lateral side wall and the outer lateral wall may be implemented as the third partial volume.

In the aforementioned embodiments and variants, the remaining space between the vacuum packaging device, and the front wall or one of the side walls of the drawer may be implemented as a working space or surface, in particular usable for vacuuming operations. The working space in particular may be specially adapted to place and position items and vacuum bags to be vacuumed during vacuuming operations. This has the advantage, that no extra workspace outside the vacuum packaging arrangement is required.

In embodiments, the at least one third partial volume of the drawer may be located, adjacent, in particular immediately adjacent, to the first and/or second partial volume. Preferably, the third partial volume may be located adjacent, in particular immediately adjacent, to at least one lateral side wall, back or front wall of the drawer.

The third partial volume may be separated from the first and second partial volume by vertical walls, for example running between the front and back walls or between the side walls of the drawer.

In further embodiments it may be provided that that at least a part of the inner surfaces of the drawer, in particular the surfaces of the second partial volume configured for supporting the vacuum bag and its contents during vacuuming, are implemented or provided with a hygienic easy to clean lining, which in particular may have antimicrobial properties, i.e. made from antimicrobial materials such as particular metals and/or plastic materials.

In embodiments, the drawer or kitchen cabinet may comprise a power supply terminal, in particular integrated in the mechanical structure of the drawer and/or the kitchen cabinet. The power supply terminal may be specially adapted and configured to allow electrically connecting a power connector of the vacuum packaging device.

The power supply terminal may for example integrated in the back wall or bottom of the drawer, or, if integrated in the kitchen cabinet, in a section of the cabinet behind the drawer. In particular in this case, the back wall and/or bottom of the drawer may comprise cable routings adapted to account for possible movements of the drawer so as to avoid damages to the cables while opening or closing the drawer. Providing a power supply terminal in particular has the advantage that the vacuum packaging device may be placed in a removable manner within the drawer such that it can be easily connected and disconnected the power supply. Also, easy replacement during maintenance and repair can be obtained.

In embodiments, the vacuum packaging arrangement may comprise a safety switching arrangement configured to deactivate or disable operation of the vacuum packaging device in case that the drawer is in a closed state, is not in the fully opened state, is not in an opened state required for properly operating the vacuum packaging device, or in case that a closing movement of the drawer is detected. The safety switching arrangement, which may be implemented as a safety switch, may further be implemented to activate or enable operation of vacuum packaging device in case that the drawer is transferred to an opened state, at least an opened state required for properly operating the device, or in case that the drawer is opened beyond a predefined position. Opening and closing states and movements may be detected by one or more position sensors.

The safety switching arrangement in particular may be implemented to immediately deactivate operability of the vacuum packaging device in case that the drawer approaches or occupies the closed state. In variants, the safety switching may be adapted to shut or switch off the vacuum packaging device a predefined time after fully closing the drawer. The safety switch may be adapted to power off the device after finishing the vacuuming operation. Such a switch may in particular be used in cases in which operation of the vacuum packaging device shall also be possible in the closed state of the drawer, such for example in cases in which vacuuming operations shall be carried out within the closed drawer. It shall be noted, that also a manual switch for manually activating and deactivating the vacuum packaging device may be provided.

In embodiments, the vacuum packaging arrangement may comprise an electronic user interface arranged at or integrated in the drawer or kitchen cabinet. A connector interface may be provided to connect the user interface to the vacuum packaging device in order to allow control and/or operational control of the vacuum packaging device via the user interface. The user interface may be a universal type user interface configured to communicate with several or different kinds of vacuum packaging devices. This in particular may contribute to the multifunctionality of the vacuum packaging arrangement, and/or be advantageous for a space saving arrangement of the vacuum packaging device within the drawer, e.g. in a rear section of the drawer.

The user interface may be provided at a front wall or section, in particular upper front wall face side, of the drawer.

The user interface may be adapted to be connected to the vacuum packaging device by at least one of a cable bound and wireless connection. A wireless user interface in particular may be implemented as a hand held apparatus, in particular freely and independently operable with respect to the drawer.

In general, the vacuum packaging device may be implemented as a clamp and weld vacuum packaging device. Such devices in particular may comprise a mechanism for clamping the vacuum bag, such as for example a vacuum bag containing a food item, at an open end, and a further mechanism for welding the clamped vacuum bag in the region of the clamped open end after having evacuated the vacuum bag.

Such clamp and weld vacuum packaging devices in particular can be operated without a special vacuum chamber, i.e. such vacuum packaging device may be implemented without a vacuum chamber in which vacuum bags containing respective items to be packaged have to be positioned for vacuum packaging.

According to claim 12 a kitchen cabinet is provided which comprises a vacuum packaging arrangement in any of the embodiments and variants as described above and further below. As to advantages and benefits of a respective kitchen cabinet, reference is made to the description above and further below applying mutatis mutandis.

According to claim 13 a kitchen furniture is provided comprising a kitchen cabinet as proposed beforehand, in particular a vacuum package arrangement in any of the above and below described embodiments and variants. Respective advantages apply mutatis mutandis.

Embodiments of the invention will now be described in more detail in connection with the annexed figures, in which.

Figure 1:
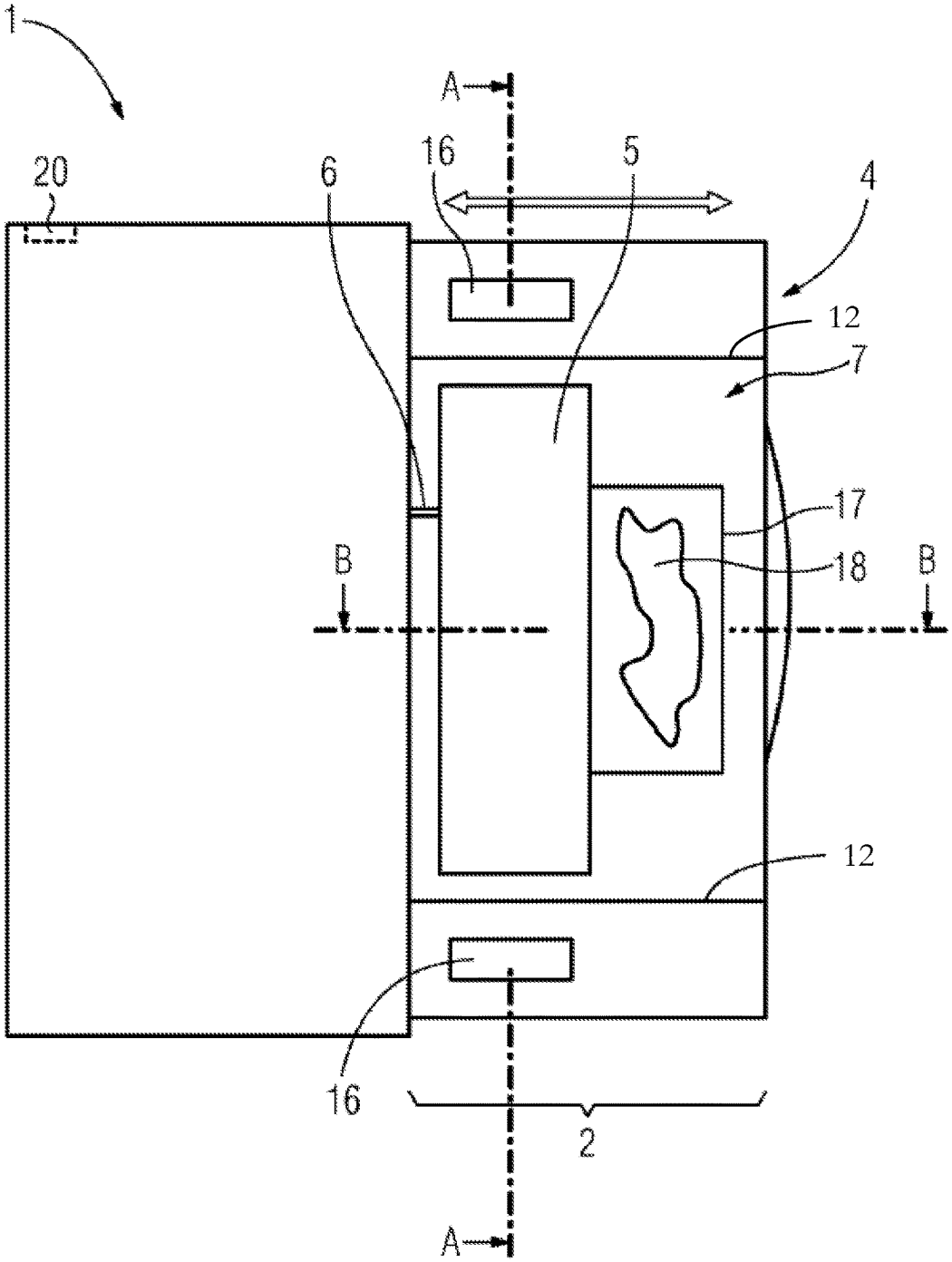
FIG. 1 shows a top view of a kitchen furniture comprising a vacuum packaging arrangement according to the underlying invention.

FIG. 1 shows a top view of a kitchen furniture 1 comprising a vacuum packaging arrangement 2 in accordance with the claims. In particular, FIG. 1 shows a top view of a kitchen cabinet 3 comprising a drawer 4, presently implemented as a push loading drawer, which accommodates a vacuum packaging device 5.

The drawer 4 is configured to be moved, as indicated via a double arrow in FIG. 1, in horizontal direction between a retracted position (not shown) and an exposed position visualized in FIG. 1.

In the exposed or opened position which in particular may correspond to the fully extended or pulled out configuration, the vacuum packaging device 5 is accessible and ready for being used by a user. In other words, the vacuum packaging device 5 is accommodated in the drawer 4 in a ready-to-use operational state.

An electrical cable connection 6 provided and configured for supplying the vacuum packaging device 5 with electrical energy is guided from a rear side of the vacuum packaging device 5 to a power supply terminal (not shown) of the kitchen furniture 1 or cabinet 3 or drawer 4. The power supply terminal in particular may be implemented within, i.e. at an inner side of, the kitchen cabinet 3 and/or drawer 4.

Figure 2:
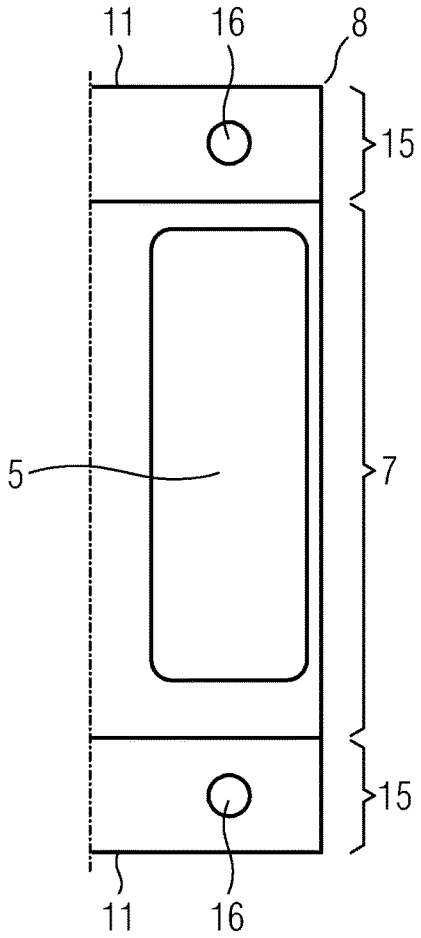
FIG. 2 shows a first cross sectional view of a component of the vacuum packaging arrangement along line A-A in FIG. 1.
Figure 3:
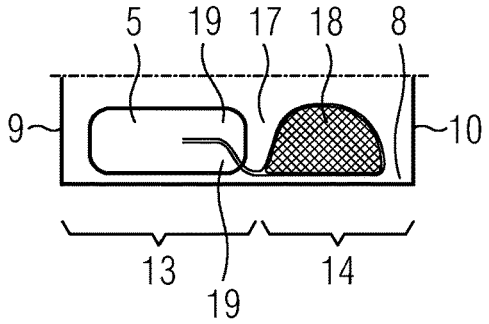
FIG. 3 shows a second cross sectional view of the component of the vacuum packaging arrangement along line B-B in FIG. 1.

As can be seen in more detail from a combination of FIGS. 1 to 3, wherein FIG. 2 shows a first cross sectional view of the drawer 4 according to line A-A in FIG. 1, and FIG. 3 shows a second cross sectional view of the drawer 4 according to line B-B in FIG. 1, the vacuum packaging device 5 is accommodated in a drawer subsection 7 of the drawer 4.

It shall be noted that the vacuum packaging device 5 in the present case may be accommodated in the drawer 4 in a removeable manner, which in particular shall mean that the vacuum packaging device 5 can be toollessly removed from and installed in, in particular placed into, the drawer 4. In particular, the vacuum packaging device 5 may be placed in the drawer 4 in a relatively loose arrangement without requiring any separate fixing elements.

The drawer 4 in particular may comprise a bottom plate 8 and four side walls running along the outer rim of the bottom plate 8. In more detail, the drawer 4 may comprise a back wall 9, a front wall 10 and two lateral side walls 11. The bottom plate 8 and the four side walls 9, 10 and 11 define a volume or space in which the vacuum packaging device 5 is arranged. This in particular means that the vacuum packaging device 5 is accommodated in the inner volume, i.e. interior, of the drawer 4, which inner volume is defined by the bottom plate 8 and the side walls 9, 10 and 11.

As already indicated, the vacuum packaging device 5 is accommodated or arranged in a drawer subsection 7, i.e. a drawer sub-volume. The drawer subsection 7 in which the vacuum packaging device 5 is accommodated in the present case further is defined by two drawer partition walls 12, running through the inner volume of the drawer 4 and connecting between the back wall 9 and the front wall 10 of the drawer 4.

Note that the drawer subsection 7 may be defined by other constructional elements, in particular bars, rods and other segmenting elements and designs. Further it shall be noted, that the drawer subsection 7, in more general the division of the inner drawer volume into subsections, may differ from that shown in the figures.

The drawer subsection 7 in which the vacuum packaging device 5 is accommodated is laterally bordered or limited by the drawer partition walls 12.

Making in particular reference to FIG. 1 and FIG. 3, the vacuum packaging device 5 is arranged and positioned in a rear drawer subsection 13, which is part of the drawer subsection 7, adjacent to the back wall 9. This in particular may have the advantage that the space left between the vacuum packaging device 5 and the front wall 10, i.e. a front drawer subsection 14, can be used and in the shown exemplary embodiment is configured as a working area for carrying out vacuum packaging operations. Here it shall be mentioned that the vacuum packaging device 5 and the back-to-front dimension of the drawer 4 may be designed, configured and matched such that sufficient space is left in an area in front of the vacuum packaging device to be used as a working area.

The drawer partition walls 12 separate the drawer subsection 7 and at the same time respectively define two lateral subsections 15 immediately adjacent to the lateral side walls 11. The lateral subsections 15 presently are implemented and configured for accommodating therein vacuum packaging equipment, such as for example vacuum bag rolls 16, for use with the vacuum packaging device 5 during operation.

An adequate partitioning of the inner drawer volume in particular is helpful for keeping the vacuum packaging arrangement 2 tidy and clean.

In particular with regard to keeping the inner surfaces of the drawer 4 tidy and clean, it shall be mentioned that the inner surfaces of the drawer 4 at least partially can be provided with easy to clean surfaces, in particular surface materials or coatings.

The vacuum packaging device 5 in the present implementation is a clamp and weld packaging device, which means that vacuum bags 17 containing food 18 to be vacuum-packaged are clamped between upper and lower clamps 19. The vacuum bags 17 are closed, in the clamped state, via a welding device or mechanism (not shown) after removing air from the vacuum bag interior.

In optional variants, the vacuum packaging arrangement 2 may comprise a safety switching arrangement 20, which is indicated in FIG. 1 in dotted lines because of being only optional. The safety switching arrangement 20 may for example be implemented as an end switch which may be provided at a rear side of the kitchen cabinet 3. The safety switching arrangement 20 may be configured to deactivate the vacuum packaging device 5, in particular to deactivate the electrical supply, such that in the closed state of the drawer the vacuum packaging device 5 cannot be operated. Further, the safety switching arrangement 20 may be adapted to activate operation of the vacuum packaging device 5 in the opened state of the drawer 4, in particular in the fully extended state of the drawer 4.

In further variants, the vacuum packaging arrangement 2 may comprise a user interface (not shown) which may be configured to control operation of the vacuum packing device 5. The user interface may be implemented as a stand-alone in particular separate device, i.e. not on or at the vacuum packaging device 5. The user interface may be connected via cable and/or with a cable-less connection to the vacuum packaging device 5.

Figure 4:
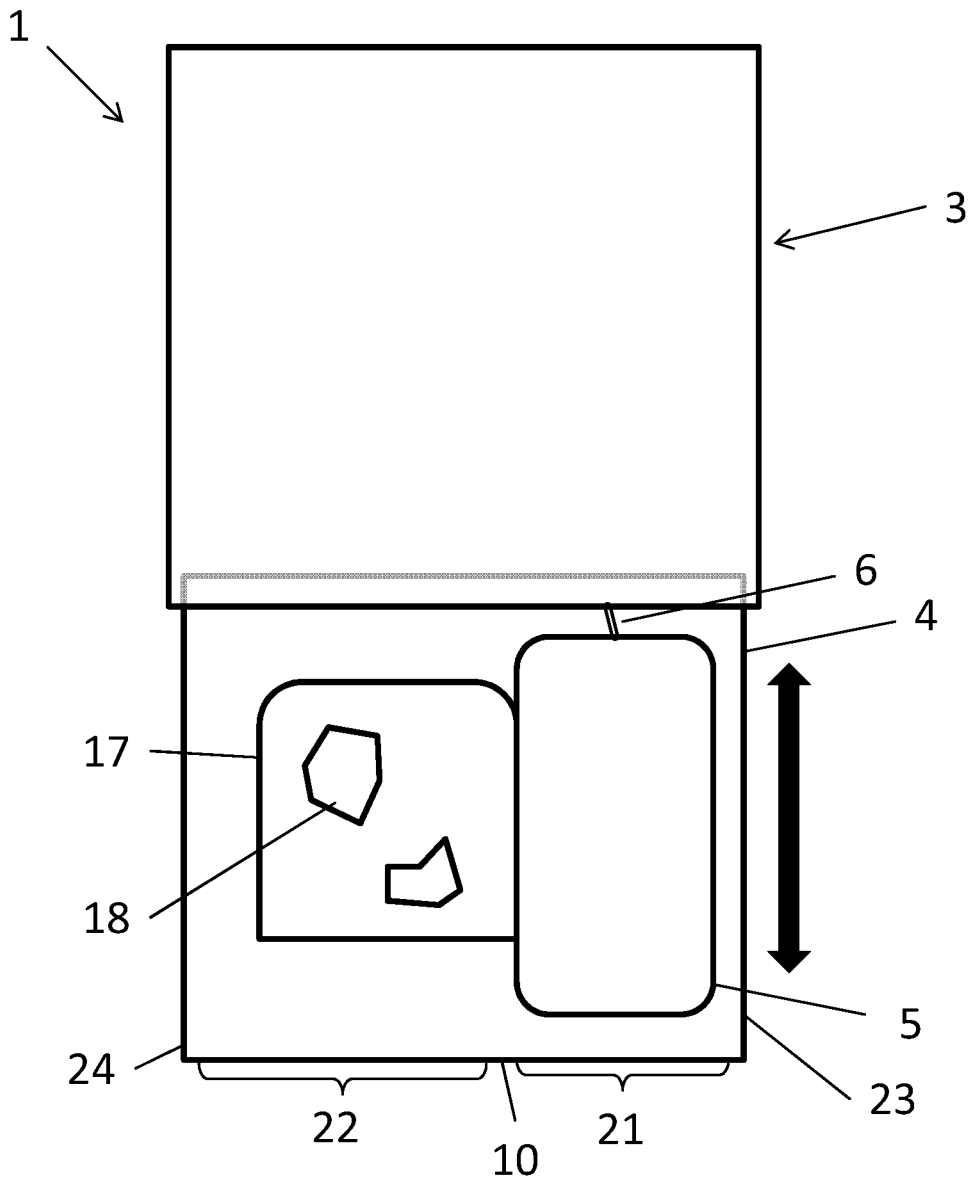
FIG. 4 shows an alternative configuration of a vacuum packaging arrangement.

FIG. 4 shows an alternative arrangement of a vacuum packaging arrangement 1. As can be seen from a comparison of FIG. 4 with FIGS. 1 to 3, the alternative arrangement differs from the arrangement shown in FIGS. 1 to 3 in that the vacuum packaging device 5 is arranged in its lengthwise direction in a front to back orientation. In the arrangement in FIGS. 1 to 3, the vacuum packaging device 5 is in its lengthwise direction oriented in parallel to the lateral width of the drawer 4.

In the alternative arrangement, the vacuum packaging device 5 is positioned in a right drawer subsection 21, immediately adjacent to the right side wall 23. The space left towards the left side wall 24 defines a left drawer subsection 22 which is designed and usable as a working space and surface for vacuuming operations, for example for supporting the vacuum bag 17 and related food items 18 arranged therein during vacuuming the vacuum bag 17. A back or front drawer subsection, which is not explicitly indicated in FIG. 4, may for example be defined between the back wall 9 and the right 21 and left drawer subsection and/or between the front wall 10 and the right 21 and left drawer subsection 22. The front and/or back drawer subsections may be adapted to accommodate items, for example vacuum device consumables such as vacuum bags, and the like. Note that the double arrow in FIG. 4 shall indicate the possible movement of the drawer into and out of the kitchen cabinet 3. It shall be noted, that all the optional features mentioned in connection with the embodiment shown in FIGS. 1 to 3, such for example the antimicrobial and/or self-cleaning liner of the work surface or area, the end stop or safety switch arrangement and/or user interface may also be provided with the alternative embodiment as shown in FIG. 4. Further, the vacuum packaging device 4 may be implemented as described in connection with FIGS. 1 to 3.

In all it shall become clear, that the vacuum packaging arrangement as proposed herein can be implemented in a comparatively easy and space saving design, is able to provide a multifunctional working area, in particular for kitchen cabinets and kitchen furniture.

Figure 5:
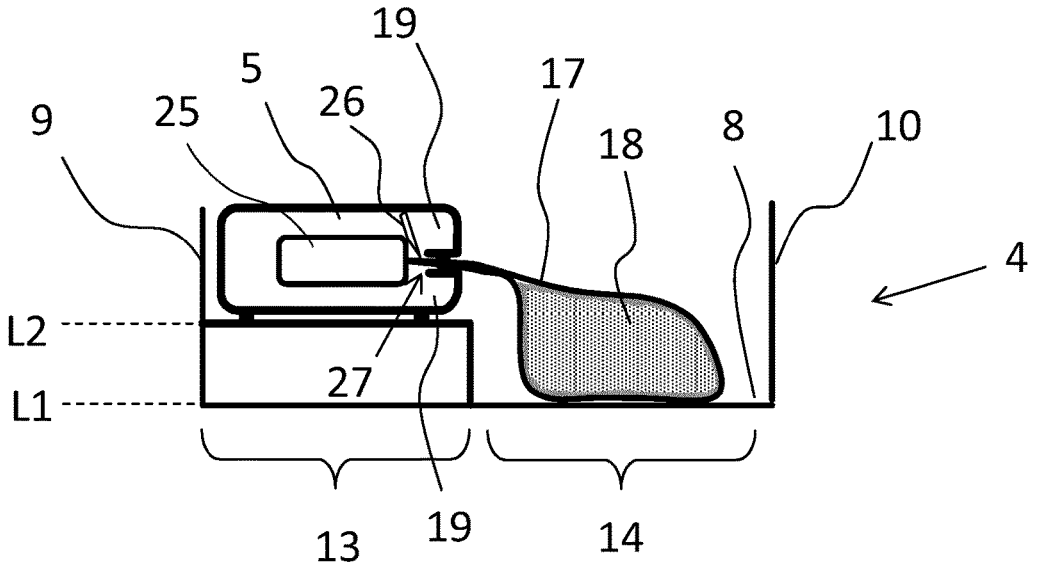
FIG. 5 shows an alternative of the vacuum packaging arrangement as compared to FIG. 3.

FIG. 5 shows an alternative configuration or design of the vacuum packaging arrangement 1 as compared to FIG. 3. In the configuration as shown in FIG. 5, the vacuum packaging device 5 is positioned at a second level L2 lying vertically above the first level L1 corresponding essentially to the level of the bottom plate of the drawer 4. During vacuuming, the vacuum bag 17 and its content, in particular food 18 contained therein, is positioned on the lower first level L1. This configuration may have the advantage over the configuration as shown in FIG. 3 that fluids are kept from entering the vacuum pump 25 by the action of gravity. This in particular is obtained in that the vacuum bag 17 is positioned at a lower level than the vacuum packaging device 5 and vacuum pump.

A minor first section 27 of the vacuum bag 17 comprising the open end of the vacuum bag 17 is clamped and accommodated within the clamp and weld vacuum packaging device 5, whereas a major second section of the vacuum bag 17 that comprises the closed end of the vacuum bag 17 is positioned or arranged outside of the vacuum packaging device 5. The major second section is accommodated on the bottom plate 8 at the first level L1 below the second level L2.

A kind of measure of safety to avoid entrance of fluid or liquid into the vacuum packaging device 5 and in particular vacuum pump 25, which has a high risk to be damaged by ingress of liquids, may in embodiments be to provide a liquid or moisture sensor 26 as schematically and exemplarily depicted in FIG. 5. In case of liquid reaching or approaching the entrance site of the vacuum pump 25, the moisture sensor 26 may trigger stopping vacuuming so as to avoid moisture advancing further towards the vacuum pump 26. As already indicated, the sensor 26 is only optional and can readily be provided with other variants and embodiments, in particular with the one as shown and described in FIG. 3.

LIST OF REFERENCE NUMERALS

1 kitchen furniture
2 vacuum packaging arrangement
3 kitchen cabinet
4 drawer
5 vacuum packaging device
6 cable connection
7 drawer subsection
8 bottom plate
9 back wall
10 front wall

11 lateral side wall
12 drawer partition wall
13 rear drawer subsection
14 front drawer subsection
15 lateral subsection
16 vacuum bag roll
17 vacuum bag
18 food
19 clamp
20 safety switching arrangement
21 right drawer subsection
22 left drawer subsection
23 right side wall
24 left side wall
25 vacuum pump
26 moisture sensor
27 minor first section
L1 first level
L2 second level

The invention claimed is:

1. A vacuum packaging arrangement comprising:

a drawer configured to cooperate with a kitchen cabinet, the drawer having different first and second sections, the second section being lower than the first section; and a vacuum packaging device configured for vacuum packaging items in vacuum bags, the vacuum packaging device comprising an operational interface configured to receive a minor first section of a vacuum bag that comprises an open end of said vacuum bag during a vacuuming operation, and to vacuum the vacuum bag during said vacuuming operation upon activation of the vacuum packaging device, wherein a major second section of the vacuum bag that comprises a closed end of the vacuum bag is arranged outside of the vacuum packaging device, and wherein the vacuum packaging device is disposed in the first section of the drawer, and the major second section of the vacuum bag is disposed in the second section of the drawer during the vacuuming operation.

2. The vacuum packaging arrangement according to claim 1, wherein the vacuum packaging device is configured such that an outer surface of at least the major second section is exposed to atmospheric pressure during the vacuuming operation.

3. The vacuum packaging arrangement according to claim 1, wherein the interface comprises a welding unit configured for vacuum-tightly sealing vacuum bags by generating a vacuum bag welded seam.

4. A vacuum packaging arrangement according to claim 3, said interface further comprising a clamping unit configured for clamping the minor first section of the vacuum bag at least during generating the welded seam.

5. The vacuum packaging arrangement according to claim 1, wherein a height difference between the first section and the second section is such that at least the major second section or at least a major part of the vacuum bag can rest substantially upright during the vacuuming operation.

6. The vacuum packaging arrangement according to claim 1, comprising a sensor arrangement configured to detect liquid flowing out of the major second section of the vacuum bag during the vacuuming operation, in a direction towards a vacuum pump of the vacuum packaging device, wherein the sensor arrangement comprises a control unit adapted to stop the vacuuming operation or issue a warning if a liquid flows from the major second section towards the vacuum pump.

7. The vacuum packaging arrangement according to claim 1, wherein the first and second sections correspond to first and second partial volumes of the interior of the drawer, respectively, and wherein a bottom section of the drawer in the second partial volume is configured as a support surface for supporting the vacuum bag during the vacuuming operation.

8. The vacuum packaging arrangement according to claim 7, wherein the drawer comprises a third partial volume, distinct from the first and second sections, and configured for accommodating therein vacuum packaging machine related consumables.

9. The vacuum packaging arrangement according to claim 8, wherein the third partial volume of the drawer is located laterally to, in front of or behind the first and/or second partial volume and adjacent to at least one lateral side wall, front wall or back wall of the drawer.

10. The vacuum packaging arrangement according to claim 7, wherein the drawer comprises a back wall and an opposing front wall spaced therefrom, wherein the first partial volume is located in a rear drawer subsection adjacent to the back wall, and the second partial volume is located in a front drawer subsection adjacent to the front wall.

11. The vacuum packaging arrangement according to claim 7, wherein the drawer comprises two lateral side walls, and wherein the first partial volume is located adjacent to one of the lateral side walls.

12. A vacuum packaging arrangement according to claim 11, wherein the second partial volume is located adjacent to the other lateral side wall, and/or the first and second partial volumes are arranged immediately adjacent to one another.

13. The vacuum packaging arrangement according to claim 1, wherein at least a part of an inner surface of the drawer comprises a hygienic lining.

14. The vacuum packaging arrangement according to claim 1, wherein the drawer comprises a power supply terminal configured to be electrically connected to a power connector of the vacuum packaging device.

15. The vacuum packaging arrangement according to claim 1, comprising a safety switching arrangement configured to deactivate the vacuuming operation of the vacuum packaging device in a closed state of the drawer, and to activate the vacuuming operation of the vacuum packaging device in an opened state of the drawer.

16. The vacuum packaging arrangement according to claim 1, comprising an electronic user interface arranged at or integrated in the drawer and/or kitchen cabinet, and configured to allow control and/or operational control of the vacuum packaging device.

17. A kitchen cabinet comprising the vacuum packaging arrangement according to claim 1.

18. A kitchen furniture comprising the kitchen cabinet according to claim 17.

19. The vacuum packaging arrangement according to claim 1, said vacuum bag being disposed in said drawer such that the major second section thereof is received in the second section of the drawer and the minor first section thereof is received in said operational interface of said vacuum packaging device.

20. A vacuum packaging arrangement comprising:

a drawer configured to cooperate with a kitchen cabinet, the drawer having different first and second sections, the second section being lower than the first section;

a vacuum packaging device configured for vacuum packaging items in vacuum bags, the vacuum packaging device comprising an operational interface configured to receive a minor first section of a vacuum bag, said minor first section comprising an open end of said vacuum bag, said operational interface configured to vacuum the vacuum bag upon activation of the vacuum packaging device, wherein a major second section of the vacuum bag, comprising a closed end thereof, is arranged outside of the vacuum packaging device, the operational interface comprising a welding unit configured to vacuum-tightly seal the vacuum bag by generating a vacuum bag welded seam, and a clamping unit configured to clamp the minor first section of the vacuum bag while generating the vacuum bag welded seam, and wherein the vacuum packing device is disposed in the first section of the drawer and the major second section of the vacuum bag is disposed in the second section of the drawer during a vacuuming operation; and a sensor arrangement configured to detect liquid flowing out of the major second section of the vacuum bag during the vacuuming operation, in a direction towards a vacuum pump of the vacuum packaging device, the sensor arrangement comprising a liquid sensor and a control unit adapted to stop the vacuuming operation or issue a warning if a liquid flows from the major second section towards the vacuum pump, said liquid sensor being arranged between the clamping unit and the vacuum pump.

21. The vacuum packaging arrangement according to claim 20, comprising a safety switching arrangement configured to deactivate the vacuuming operation of the vacuum packaging device in a closed state of the drawer, and to activate the vacuuming operation of the vacuum packaging device in an opened state of the drawer.

* * * * *